US005638752A

United States Patent [19]

Hartung et al.

[11] Patent Number: 5,638,752

[45] Date of Patent: Jun. 17, 1997

[54] MULTI-COLOR OFFSET PRINTING PRESS FOR PRINTING AND IN-LINE COATING

[75] Inventors: Georg Hartung, Seligenstadt; Ulrich Jung, Limburg; Jurgen Schneider, Frankfurt am Main, all of Germany

[73] Assignee: MAN Roland Druckmaschinen AG, Germany

[21] Appl. No.: 507,846

[22] Filed: Jul. 27, 1995

Related U.S. Application Data

[63] Continuation of Ser. No. 222,087, Apr. 4, 1994, abandoned.

[30] Foreign Application Priority Data

Apr. 16, 1993 [DE] Germany ..... 9305552 U

[51] Int. Cl.[6] ..... B41F 7/06; B41F 31/08

[52] U.S. Cl. ..... 101/177; 101/183

[58] Field of Search ..... 101/366, 363, 101/364, 350, 365, 148, 142, 143, 352, 181, 183, 177, 46; 118/261, 262, 211

[56] References Cited

U.S. PATENT DOCUMENTS

| | | | |
|---|---|---|---|
| 3,880,077 | 4/1975 | Glaser et al. | 101/350 X |
| 4,308,796 | 1/1982 | Satterwhite | 101/143 |
| 4,617,865 | 10/1986 | Switall | 101/350 |
| 4,685,414 | 8/1987 | DiRico | 118/46 |
| 5,010,817 | 4/1991 | Grosshauser | 101/350 X |
| 5,207,159 | 5/1993 | DeMoore | 101/350 |

FOREIGN PATENT DOCUMENTS

| | | |
|---|---|---|
| 30 46 257 C2 | 2/1984 | Germany . |
| 34 27 898 C1 | 11/1985 | Germany . |
| 36 14 582 A1 | 11/1987 | Germany . |
| 39 06 648 A1 | 10/1989 | Germany . |
| 41 22 990 A1 | 1/1993 | Germany . |

OTHER PUBLICATIONS

FlexoDruck [FlexoPrinting] "*Gold–lacquer printing supersedes metal bronzing,*" Feb. 1993, pp. 42–43.

*Primary Examiner*—J. Reed Fisher
*Attorney, Agent, or Firm*—Leydig, Voit & Mayer, Ltd.

[57] ABSTRACT

A multi-color offset printing press for the printing and in-line coating of materials is disclosed. The printing press includes an in-line flexographic printing/lacquering unit for applying coating fluids to materials printed in the printing press. The flexographic printing/lacquering unit may be installed upstream of the first printing unit, downstream of the last printing unit or in between printing units.

6 Claims, 3 Drawing Sheets

MULTI-COLOR OFFSET PRINTING PRESS FOR PRINTING AND IN-LINE COATING

This is a continuation of application Ser. No. 08/222,087 filed on Apr. 4, 1994, now abandoned.

FIELD OF THE INVENTION

The present invention relates generally to sheet fed rotary printing machines for polychrome offset printing and more particularly concerns a multi-color offset printing press having an in-line flexographic printing/lacquering unit for the printing and in-line coating of materials.

BACKGROUND OF THE INVENTION

The article "Gold-lacquer printing supersedes metal bronzing," published on pages 42–43 of the February, 1993 edition of the periodical FlexoDruck [FlexoPrinting] describes a printing process wherein a gold-lacquer ink is processed in a multi-color offset printing machine having two so-called lacquer towers. One of the lacquer towers used in this process was converted from a flexographic printing unit and used a flexographic printing plate for coating with a conventional lacquering technique. In comparison with conventional lacquer metering, the article points out that a chamber doctor could be used with the apparatus.

DE 3,906,648 A1 illustrates an applicator unit for use with either high-viscosity, oil-containing layers or low-viscosity, water-soluble layers. The disclosed applicator unit is designed as a lacquering device which can be used either as an offset typographic unit or as an intaglio printing unit. If used as an offset typographic unit, the design starts from a structured scoop roller corresponding to a doctor blade. If used as an intaglio printing unit, the design starts from an applicator roller and a structured form cylinder corresponding to a doctor blade. The typographic printing unit consists of 1) a scoop roller whose surface is engaged by a doctor blade and whose surface profile includes small cups; 2) a transfer roller engaged by smoothing rollers; and 3) a form cylinder equipped with a typographic printing form.

DE 4,122,990 A1 discloses a bronze and fancy-effect printing ink and a process for producing a bronze and fancy-effect print. More specifically, it describes a water-dilutable printing ink having high viscosity and a high pigment fraction. This ink is processed with the lacquer unit of an offset machine or from a flexographic printing unit. A short processing path with few color splits is described as an advantage of this approach.

DE 3,046,257 C2 describes an apparatus having a lacquer-supply container and a scoop roller. In this apparatus, the lacquer picked up by the scoop roller is fed to an applicator roller in a metered manner. Two doctor rollers can be thrown onto the scoop roller and a doctor blade can be thrown onto the metering roller for stripping off lacquer.

DE 3,427,898 C1 discloses an apparatus which meters lacquer by way of a lacquer gap formed between two rollers.

The devices taught by DE 3,046,257 C2, DE 3,906,648 A1, and DE 3,427,898 C1 share at least one disadvantage. When used to process fluids having high viscosities such as fluids with viscosities from approximately 0.1 to 2 Pas, so-called lacquer nests can occur. Specifically, the yield points of these high viscosity fluids can result in faults in the fluid flows which could in turn lead to lacquer nests where lacquer easily dries in an undesirable manner.

DE 3,614,582 A1 discloses a so-called chamber doctor for applying a coating mass onto a coating roller. In this disclosure, at least two doctor blades bearing on a roller form a chamber for receiving a coating mass. One disadvantage of this structure is that the coating mass, which is fed to the chamber under pressure, can escape only by way of the doctor gap. A further disadvantage is that the excess coating mass is returned via a pressureless space. Finally, when fluids of higher viscosity are used, deposits can build up on the doctor blades and lead to printing faults.

OBJECTS AND SUMMARY OF THE INVENTION

It is therefore an object of the present invention to provide a multi-color offset printing press for the printing and in-line coating of materials. It is a related object to provide a printing press which performs the in-line processing of quick-evaporating printing inks by applying high viscosity, water-dilutable layers of specific thickness which have fancy effect and/or act as a protective lacquer over the printed materials. It is another related object to provide a printing press which permits the in-line processing of special compositions having either a high pigment fraction or coarse pigments.

It is a further object to provide a multi-color offset printing press which can be combined with additional treating, printing, or coating devices to perform multiple operations in a single, in-line printing machine. It is still another object of the present invention to provide a printing press for the in-line coating of printed materials with coating fluids having viscosities of approximately 0.1 to 2 Pas.

Yet another object of the present invention is to provide a flexographic printing/lacquering unit for supplying coating fluids used in the in-line coating of printed materials to a printing press. Finally, it is a related object to provide a flexographic printing/lacquering unit which limits the evaporation of quick evaporating fluids used in a multi-color printing press which performs the in-line printing and coating of materials.

The present invention achieves these objectives by providing a multi-color offset printing press comprising at least one offset printing unit and at least one lacquering unit designed as a flexographic printing unit to enable the in-line coating of materials printed by the printing unit(s) even when high-viscosity fluids are employed. The flexographic printing/lacquering unit can use lacquers or pigmented inks on a water base (metallic-luster prints) for in-line coating. In addition, the flexographic printing/lacquering unit can be used within the inventive printing press to perform either reserve lacquering (spot lacquering) or full-surface lacquering.

Pursuant to the invention, the offset printing press comprises a first offset printing unit for printing the materials; a flexographic lacquering unit for selectively coating the printed materials with coating fluids; and, a second lacquering unit disposed downstream from the flexographic lacquering unit with respect to the direction of movement of the materials through the press.

In accordance with a more specific aspect of the invention, the flexographic printing/lacquering unit for the in-line application of coating fluids to materials printed in an offset printing press includes: an impression cylinder for carrying the printed materials; a form cylinder carrying a typographic printing plate for applying the coating fluids to the printed materials carried by the impression cylinder; an applicator roller disposed in contact with the form cylinder for transferring the coating fluids to the typographic printing plate; and, a closed fluid-transport system having a reservoir containing the coating fluids, a chamber doctor disposed adjacent the applicator roller for supplying the coating fluids thereto, and a pump for circulating the coating fluids between the reservoir and the chamber doctor.

The closed fluid-transport system of the flexographic printing/lacquering unit reduces the evaporation of the coating fluids used in the printing press thereby improving the processing of quick-evaporating fluids such as water-soluble fluids. In addition, the chamber doctor of the closed fluid-transport system prevents the splashing of lacquer or ink which could occur if either open doctor-blades or a scoop roller were used. Likewise, the possible build-up of dried-on lacquer/ink residues on the doctor-blade edge is prevented by the flow of fluids through the close fluid-transport system and the chamber doctor. The inventive flexographic printing/lacquering unit, including the closed fluid-transport system and the chamber doctor, constitutes a functional module which can be used in various settings and combinations.

The inventive combination of at least one offset printing unit and at least one flexographic printing unit discussed above, can be modified in various ways without departing from the invention. For example, a conventional lacquering apparatus can be positioned downstream of the offset printing unit(s) and the flexographic printing unit(s) to perform further in-line processing of the printed materials such as full-surface lacquering.

These and other features and advantages of the invention will be more readily apparent upon reading the following description of a preferred exemplified embodiments of the invention and upon reference to the accompanying drawings wherein:

While the invention will be described and disclosed in connection with certain preferred embodiments and procedures, it is not intended to limit the invention to those specific embodiments. Rather it is intended to cover all such alternative embodiments and modifications as fall within the spirit and scope of the invention.

DETAILED DESCRIPTION OF THE PREFERRED EMBODIMENTS

Figure 1:
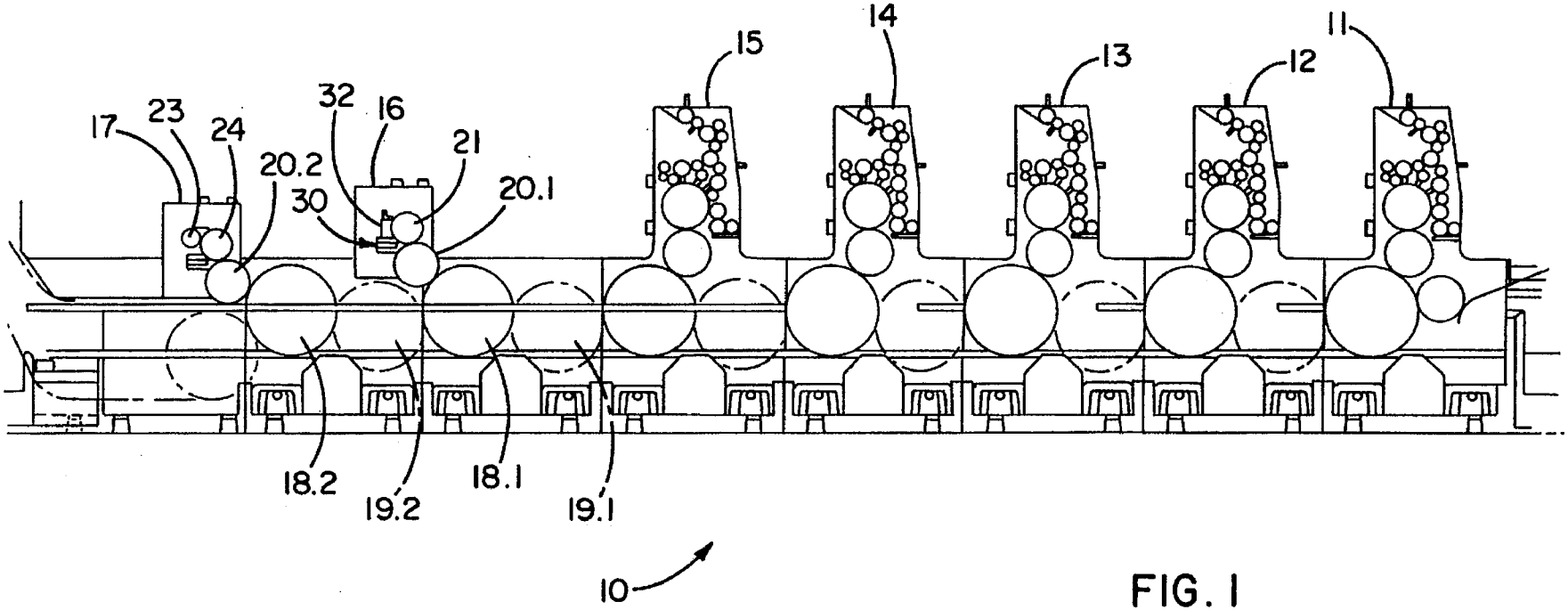
FIG. 1 shows a multi-color offset printing press constructed in accordance with the teachings of the present invention to perform the printing and in-line coating of materials.

FIG. 1 illustrates a multi-color offset printing press 10 constructed in accordance with the teachings of the present invention. The printing press 10 (shown here without a feeder and delivery) includes five printing units 11–15, a coating or lacquering device 16 comprising a flexographic printing unit disposed downstream of the printing units (in the sheet-running direction), and a second lacquering unit 17 disposed downstream of the flexographic coating device 16. The second lacquering unit 17 can be a conventional unit or another flexographic printing/lacquering unit. However, in the instant embodiment, the second lacquering unit 17 is of the conventional type. The flexographic printing/lacquering unit 16 can be used as a spot-lacquering apparatus (for reserve lacquering) and the second lacquering unit 17 can be used for full-surface refinishing. However, it will be appreciated by those skilled in the art that the flexographic printing/lacquering unit 16 can also be used for full-surface lacquering.

Both the flexographic lacquering device 16 and the second lacquering unit 17 include an impression cylinder 18.1, 18.2, a transfer drum 19.1, 19.2 and a form cylinder 20.1, 20.2.

Figure 2:
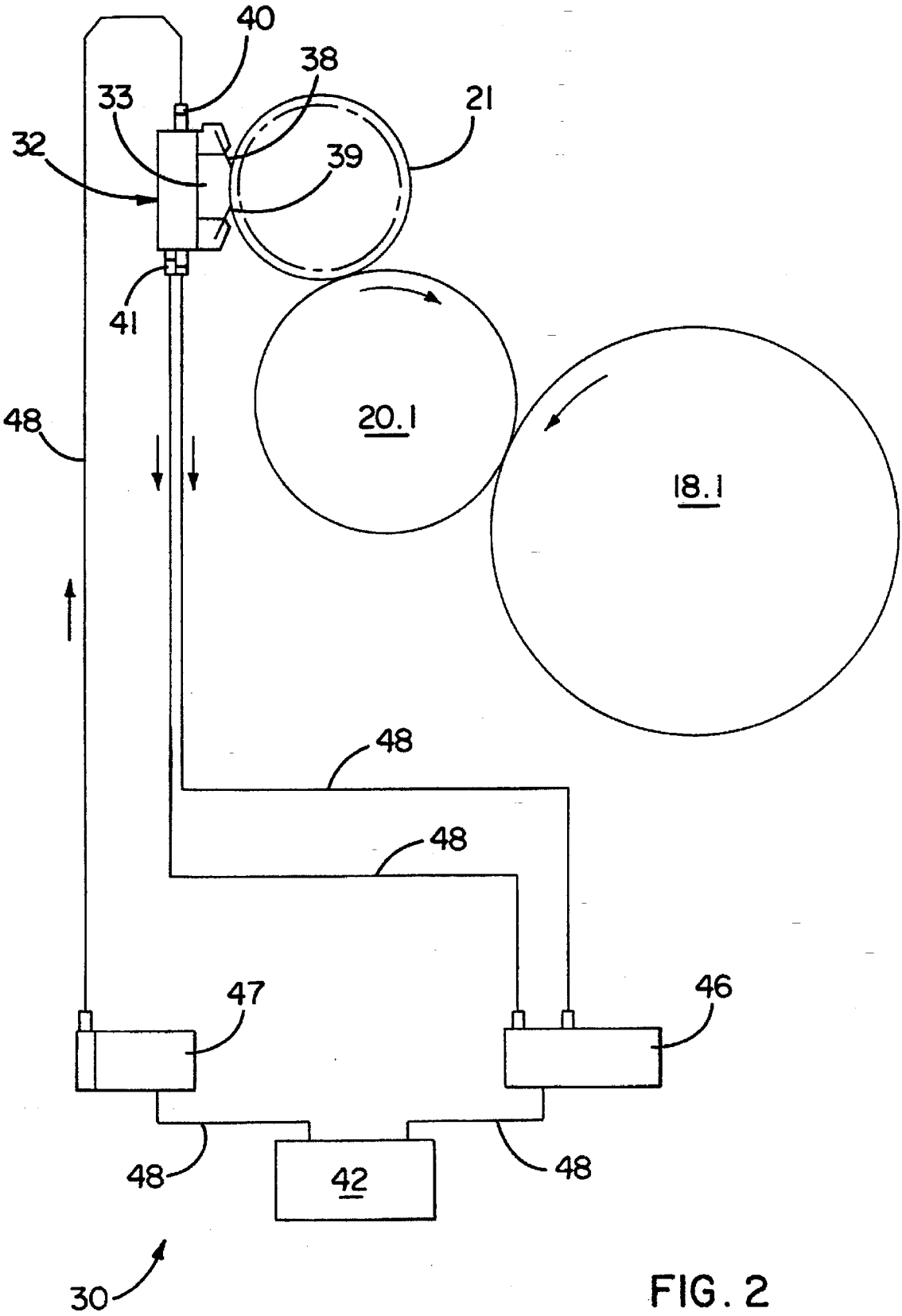
FIG. 2 shows a diagrammatic representation of a flexographic printing/lacquering unit constructed in accordance with the teachings of the present invention; and, FIG. 3 shows an alternative embodiment of the inventive multi-color offset printing press.

The form cylinder 20.1 of the flexographic lacquering unit 16 carries a clamped, flexible typographic printing plate such as a flexographic printing plate. As best seen in FIG. 2, an applicator roller 21 having a structured surface including small cups disposed in a grid pattern (i.e., a grid roller) is positioned in contact with the form cylinder 20.1. This applicator roller 21 acts as a lacquer roller.

In order to supply the applicator roller 21 with fluids, the flexographic lacquering unit 16 is further provided with a closed fluid-transport system 30. This closed fluid-transport system includes a reservoir 42, a suction pump 46, a chamber doctor 32, and a feed pump 47. These components of the closed fluid-transport system communicate through conduits 48 as set forth below.

The reservoir 42 is a holding vessel or container for holding the coating fluids for use in the in-line coating process. In order to transfer these coating fluids to the other components of the fluid-transport system, the reservoir 42 is provided with an inflow and an out-flow. The out-flow of the reservoir 42 communicates with a conduit 48 which, in turn, communicates with the feed pump 47. Feed pump 47 generates a suctioning force which draws the coating fluids through conduit 48 and transports them to the chamber doctor 32.

The chamber doctor 32 is disposed adjacent the applicator roller 21 so as to be capable of being selectively thrown onto the latter. The chamber doctor 32 includes a positive doctor blade 38, a negative doctor blade 39, and closing-off sides which combine to form a chamber 33 having an opening disposed adjacent to and facing the applicator roller 21. The positive doctor blade 38 is positioned so that it points in the direction of rotation of the applicator roller 21 and acts as a closing doctor blade. The negative doctor blade 39, on the other hand, is positioned so that it points opposite or counter to the direction of rotation of the applicator roller 21 and acts as a working doctor blade.

The housing of the chamber doctor 32 includes a fluid inflow 40 located at the top of the chamber doctor 32 for receiving the coating fluids supplied by the feed pump 47 through conduit 48 and two fluid out flow drains or run-offs 41 located at the bottom of the chamber doctor 32 for carrying the coating fluids out of the chamber 33 of the chamber doctor 32. To promote appropriate fluid flow, the fluid inflow 40 is positioned near the center of the top panel of the chamber doctor 32 and the two issuing fluid run-offs 41 are arranged near the side parts of the lower portion of the chamber doctor 32.

It will be appreciated that the use of two run-off drains 41 necessitates the use of two conduits 48 for carrying the coating fluids exiting the chamber doctor 32. These two conduits 48 communicate with the suctioning pump 46. Thus, the suctioning pump draws the coating fluids out of the chamber doctor 32 via the out-flow drains or run-offs 41, and returns them to the reservoir 42 via the reservoir's inflow. Thus, the reservoir 42, the feed pump 47, the chamber doctor 32, the suctioning pump 46, and the conduit 48 combine to form a closed fluid-transport system which circulates coating fluids. It will be appreciated by those skilled in the art that the closed nature of this system reduces the evaporation of the coating fluids. It will further be appreciated that the feed pump 47 and the suctioning pump 46 are required so that fluids such as gold and silver printing ink, zinc white or lacquer, having high viscosity as a result of their pigmentation can be processed.

In use, the reservoir 42 would first be provided with a quantity of an appropriate coating fluid. A high viscosity, water base coating fluid such as gold and silver printing ink, zinc white, or lacquer, are possible choices. This coating fluid is then conveyed from the reservoir 42 through conduit 48 into the chamber 33 of the chamber doctor 32 by the feed pump 47. The feed pressure generated by the feed pump 47 creates an overpressure inside the chamber doctor 32. As a result, some of the high viscosity coating fluid is forced from the interior of the chamber doctor 32 (i.e., chamber 33) onto the applicator roller 21 while the remaining coating fluid is forced through the fluid run-offs 41. The coating fluid which is forced through the run-offs 41 is conveyed back into the reservoir 42 by the suction pump 46.

The coating fluid which passes to the applicator roller 21, however, fills the small cups disposed in a grid pattern on the surface of the applicator roller. The rotating applicator roller 21 acts as a lacquer roller and carries the coating fluid away from the chamber doctor 32. As the applicator roller 21 rotates past the chamber doctor 32, the negative doctor blade 39 scrapes the excess coating fluid from the webs formed between the small grid-pattern cups on the surface of the applicator roller 21 thereby insuring that the coating fluid remains solely in the small grid-pattern cups. As explained above, the applicator roller 21 is in contact with the form cylinder 20.1. As a result, the coating fluids carried by the applicator roller 21 are transferred to the typographic printing form or plate stretched on the form cylinder 20.1. The typographic printing form then applies the coating fluids as a layer to the printed materials fed by the impression cylinder 18.1.

Unlike the flexographic printing/coating unit 16 described above, the second lacquering unit 17 includes a pair of rollers for forming a metering gap. More specifically, a metering roller 23 is thrown onto an applicator roller 24. A mass of coating fluids is introduced directly into the gap between these two rollers 23, 24, and is fed by way of the applicator roller 24 to the form cylinder 20.2. The form cylinder 20.2 then applies the coating fluids to the printed materials carried by the impression cylinder 18.2.

By staggering the offset printing, flexographic printing, and lacquering processes in the manner taught by the instant invention, an especially good work result can be achieved. This technique is particularly useful for metallic-luster coatings. In addition, rapid processing of either the readily evaporating metallic printing ink or the printing lacquer in combination with the subsequent lacquer coating advantageously increases the luster of the printed materials.

Figure 3:
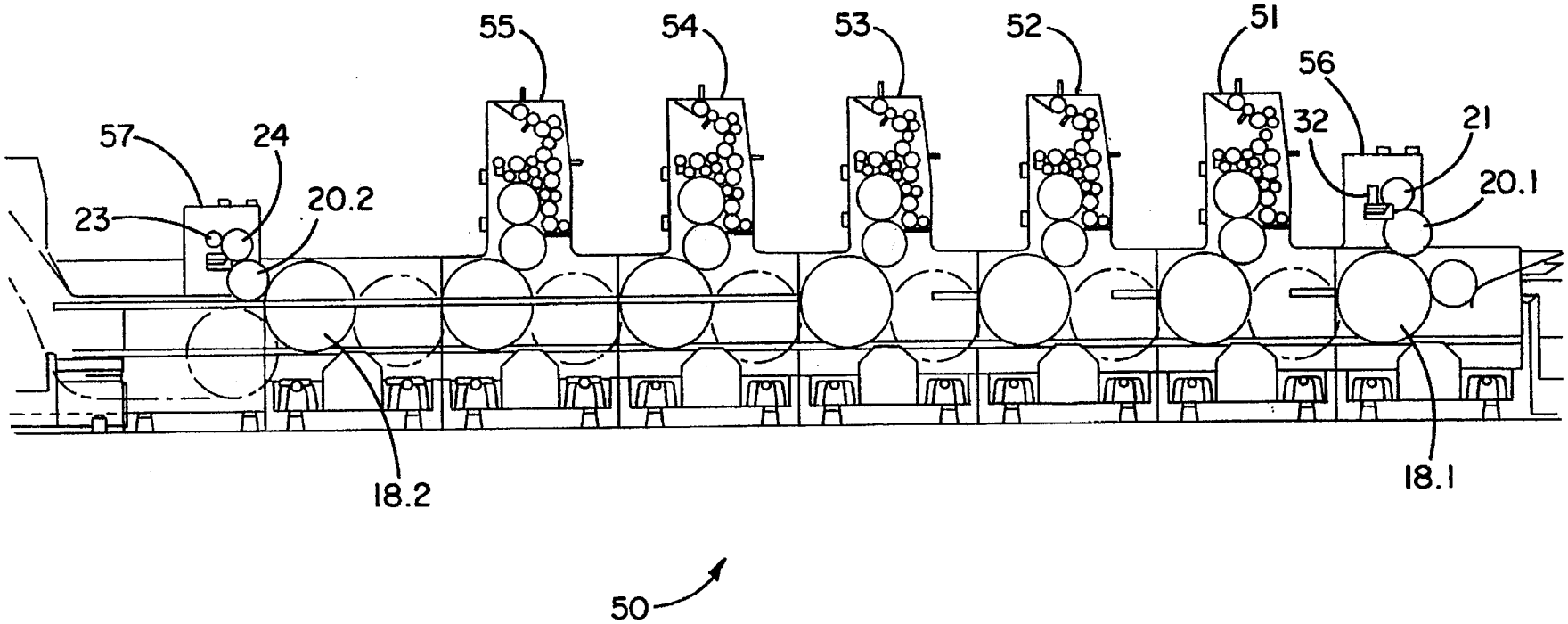

An alternative embodiment of the multi-color offset printing press 50 is illustrated in FIG. 3. In this embodiment, the flexographic printing/lacquering unit 56 is positioned upstream of the first printing unit 51. This particular configuration permits the application of basic coatings prior to printing. For example, zinc-white coatings can be applied to a sheet-metal material, plastic foil or cardboard before printing. In addition, in this embodiment, the final lacquering is performed by a second lacquering unit 57 disposed downstream of the last printing unit 55. Alternatively, an integrated lacquering unit disposed on a conventional printing unit can be employed for final lacquering.

Although particular embodiments of the invention have been disclosed, it will be appreciated that this disclosure is by no means meant to limit the scope of invention to these embodiments. For example, it will be appreciated that flexographic printing/lacquering units 16 as disclosed in the first embodiment 10 of the invention could be positioned between two or more of the printing units 11–15 of the printing press for applying intermediate coatings without departing from the invention. Such intermediate coatings might be useful for performing a drying function.

We claim as our invention:

1. An offset printing press for the printing and in-line coating of materials, the offset printing press comprising, in combination:

a first offset printing unit for printing materials;

a flexographic lacquering unit for partially coating the materials with a first layer of coating fluids having viscosities of between approximately 0.1 and 2.0 Pas inclusive, the flexographic lacquering unit having:

(1) an impression cylinder for carrying the materials, (2) a form cylinder carrying a typographic printing plate and contacting the materials carried by the impression cylinder for transferring the first layer of coating fluids thereto, (3) an applicator roller engaging the typographic printing plate on the form cylinder for transferring the coating fluids thereto, (4) a chamber doctor engaging the applicator roller for applying the coating fluids thereto, the chamber doctor comprising (a) a positive doctor blade disposed for contacting the applicator roller in its direction of rotation, (b) a negative doctor blade disposed for contacting the applicator roller counter to its direction of rotation, and (c) side portions combining with the negative and positive doctor blades to form a chamber having an opening adjacent to and facing the applicator roller, and (5) a closed fluid transport system comprising (a) a reservoir containing the coating fluids, (b) a feed pump for pumping coating fluids from the reservoir to the chamber doctor, and (c) a suction pump for pumping the coating fluids from the chamber doctor back to the reservoir; and, a second lacquering unit for fully coating the materials with a second layer of coating fluids, the second lacquering unit being disposed downstream from the flexographic lacquering unit with respect to the direction of movement of the materials through the press.

2. An offset printing press as defined in claim 1 wherein the flexographic lacquering unit is disposed upstream from the first printing unit with respect to the movement of the materials through the press such that the flexographic lacquering unit applies the first layer of coating fluids to the materials before they are printed.

3. An offset printing press as defined in claim 1 wherein the flexographic lacquering unit is disposed downstream from the first printing unit with respect to the movement of the materials through the press such that the flexographic lacquering unit applies the first layer of coating fluids to the materials after they are printed.

4. An offset printing press as defined in claim 1 further comprising a second printing unit wherein the flexographic lacquering unit is disposed between the first and second printing units for applying the first layer of coating fluids to the materials after they are printed by the first printing unit but before they are printed by the second printing unit.

5. An offset printing press as defined in claim 1 wherein the applicator roller has a surface including cups disposed in a grid pattern for receiving the coating fluids.

6. An offset printing press as defined in claim 1 wherein the second lacquering unit further comprises an impression cylinder for carrying the materials, a form cylinder contacting the materials carried by the impression cylinder for transferring the second layer of coating fluids thereto, an applicator roller engaging the form cylinder for transferring the coating fluids thereto, and a metering roller operatively engaging the applicator roller to form a metering gap therebetween for controlling the flow of the coating fluids.

* * * * *